US010597912B2

(12) United States Patent
Ko

(10) Patent No.: US 10,597,912 B2
(45) Date of Patent: Mar. 24, 2020

(54) INNER LOCK OF CONTAINER DOOR

(71) Applicant: FOR-U ENGINEERING CO., LTD., Uiwang-si, Gyeonggi-do (KR)

(72) Inventor: Young Sig Ko, Bucheon-si (KR)

(73) Assignee: FOR-U ENGINEERING CO., LTD., Uiwang, Gyeonggi-do (KR)

( * ) Notice: Subject to any disclaimer, the term of this patent is extended or adjusted under 35 U.S.C. 154(b) by 395 days.

(21) Appl. No.: 15/528,868

(22) PCT Filed: Dec. 2, 2015

(86) PCT No.: PCT/KR2015/013029
§ 371 (c)(1),
(2) Date: May 23, 2017

(87) PCT Pub. No.: WO2016/093544
PCT Pub. Date: Jun. 16, 2016

(65) Prior Publication Data

US 2017/0328095 A1 Nov. 16, 2017

(30) Foreign Application Priority Data

Dec. 9, 2014 (KR) ..... 10-2014-0176098

(51) Int. Cl.
*E05B 83/08* (2014.01)
*E05B 83/10* (2014.01)
(Continued)

(52) U.S. Cl.
CPC ..... *E05B 83/08* (2013.01); *E05B 63/185* (2013.01); *E05B 77/44* (2013.01); *E05B 83/10* (2013.01);
(Continued)

(58) Field of Classification Search
CPC ..... E05B 83/10; E05B 83/02; E05B 77/44; Y10S 292/32; Y10S 70/63; Y10S 70/65;
(Continued)

(56) References Cited

U.S. PATENT DOCUMENTS 2,169,692 A * 8/1939 Hansen ..... E05O 9/043 292/5
6,923,028 B2 * 8/2005 Caldwell ..... E05B 17/2023 292/148
(Continued)

FOREIGN PATENT DOCUMENTS

JP H07-279495 A 10/1995
JP 2004-116185 A 4/2004
KR 10-0227870 B1 11/1999

OTHER PUBLICATIONS

Cargo door rocker. Datasheet [online]. TheSamba.com, 1996 [retrieved on Nov. 24, 2012]. Retrieved from the Internet: <URL: http://www.thesamba.com/vw/forum/viewtopic.php?t=535634>.

*Primary Examiner* — Mark A Williams
(74) *Attorney, Agent, or Firm* — Rabin & Berdo, P.C.

(57) ABSTRACT

An inner lock of a door of a container is provided, in which the door of the container includes: a plurality of locking rods installed on an outer side of the door; a handle formed on the locking rods; a retainer which is coupled to the door and on which the handle is seated; and a handle hatch which is rotatably coupled to an upper side of the retainer and binds or releases the handle, and the inner lock includes a rotation shaft passed through the door and extended to an inner side and an outer side of the container; a plate coupled to the rotation shaft extended to the inner side; a lifting member rotatably coupled to the plate; and a locking bar coupled to a lower side of the lifting member to lock or unlock the door by being fixed to or separated from a lower frame, in which the handle hatch is coupled to the rotation shaft extended to
(Continued)

the outer side such that the locking bar is manipulated by rotating the rotation shaft from the outer side of the door.

2 Claims, 6 Drawing Sheets

(51) Int. Cl.

| | |
|---|---|
| ***E05B 63/18*** | (2006.01) |
| ***E05B 77/44*** | (2014.01) |
| ***E05B 83/14*** | (2014.01) |
| ***E05B 85/12*** | (2014.01) |
| *E05B 63/00* | (2006.01) |
| *E05B 77/14* | (2014.01) |

(52) U.S. Cl.
CPC ..... *E05B 83/14* (2013.01); *E05B 85/12* (2013.01); *E05B 63/0004* (2013.01); *E05B 77/14* (2013.01)

(58) Field of Classification Search
CPC ..... E05C 9/043; E05C 9/06; E05C 19/003; E05C 9/16; B65D 2211/00; B65D 90/008
See application file for complete search history.

(56) References Cited

U.S. PATENT DOCUMENTS

| | | | | |
|---|---|---|---|---|
| 7,234,755 | B1 * | 6/2007 | Senn | E05B 47/026 292/DIG. 32 |
| 2002/0178767 | A1 | 12/2002 | Lemley et al. | |
| 2007/0200362 | A1 * | 8/2007 | Bacco | E05B 53/003 292/218 |

* cited by examiner

RELATED ART

RELATED ART

INNER LOCK OF CONTAINER DOOR

CROSS-REFERENCE TO RELATED APPLICATIONS

This application claims priority from Korean Patent Application No. 10-2014-0176098, filed on Dec. 9, 2014 in the Korean Intellectual Property Office, the disclosure of which is incorporated herein by reference in its entirety.

BACKGROUND

Technical Field

The present disclosure relates to an apparatus for locking a door of a container from inside, and more particularly, to an inner lock of a door of a container, which maintains locked state from inside even when a locking rod (i.e., outer lock) is forcibly separated, to thus prevent door opening by a stranger.

Description of the Related Art

Generally, a container is a box-type loading case provided to carry a cargo efficiently and economically. The container is made of woods, plywoods, steel, aluminum, light alloy, fiber reinforced plastics (FRP), and so on, and classified for general use, liquid use, automobile use, refrigeration use, heat insulation use, and so on, depending on which type of cargo is carried.

The container provides advantages including: reduced time and cost because general merchandise and special cargo can be carried with ease without requiring outer packaging; prevention of accident such as damages to cargo, loss or theft that can occur during transportation; and reduced working hours because it is easy to ship the cargo onto freight cars, automobiles, ships, and so on. In particular, a container mounted on a car to carry a cargo is provided with a door installed on a rear surface of the container pivotably on a hinge, and a lock configured to control opening and closing of the door.

As illustrated in FIG. 1, a related container door includes a plurality of locking rods 11 provided at a lateral spacing from one another, along a vertical direction on an outer side of a pair of doors 10, in which upper sides and lower sides of the locking rods 11 are fixedly inserted into fixing parts 12 coupled to upper and lower frames of the container.

A handle 13 is formed on a lower end of the locking rod 11 to rotate the locking rod 11 in a lateral direction, and the handle 13 is seated on an upper side of a retainer 14 that is coupled to the door 10. On the upper side of the retainer 14, there is a handle hatch 15 rotatably coupled to the door 10.

Accordingly, as illustrated in FIG. 2, the retainer 14 and the handle hatch 15 are respectively provided with opposing binding holes 14*a*, 15*a*, and binding holes 14*a*, 15*a* are bound with a wire or a lock to prevent rotation of the handle 13 and subsequently prevent opening of the doors 10 by a stranger.

In order to open the doors 10, a user opens the handle hatch 15 in an upward direction by rotating it 15 in an arrowed direction, and rotates the handle 13 seated on the retainer 14 in a forward direction as indicated by an arrow, according to which the locking rods 11 are lowered by weights thereof and are thus withdrawn from the fixing parts 12 and moved from the upper side to an unlocked state.

However, in a related art, it may not be easy to unlock the retainer 14 and the handle hatch 15 as these are securely bound, but there is a possibility that the doors 10 can be forced open by breaking the brackets securing the fixing parts 12 and the locking rods 11 of the upper and lower sides onto the doors 10.

SUMMARY

The present disclosure has been made to overcome the problems mentioned above, and it is an object of the present disclosure to provide an inner lock of a door of a container, which is capable of preventing a forced opening of the container door by a stranger, with an improvement that allows the inner lock to lock and unlock the door of the container from inside.

It is another object of the present disclosure to provide an inner lock of a door of a container, which is provided in a simple configuration, thus reducing product price and cost for installing the product.

According to an exemplary embodiment of the present disclosure, an inner lock of a door of a container is provided, in which the door of the container includes: a plurality of locking rods installed on an outer side of the door; a handle formed on the locking rods; a retainer which is coupled to the door and on which the handle is seated; and a handle hatch which is rotatably coupled to an upper side of the retainer and binds or releases the handle, and the inner lock includes a rotation shaft passed through the door and extended to an inner side and an outer side of the container; a plate coupled to the rotation shaft extended to the inner side; a lifting member rotatably coupled to the plate; and a locking bar coupled to a lower side of the lifting member to lock or unlock the door by being fixed to or separated from a lower frame, in which the handle hatch is coupled to the rotation shaft extended to the outer side such that the locking bar is manipulated by rotating the rotation shaft from the outer side of the door.

Further, a housing is coupled with an outer circumference of the rotation shaft. A bearing is coupled with one side of the housing, and a bushing is coupled with other side. A seal space is formed between the bearing and the bushing, and the seal space is filled with a grease to block a moisture ingress.

Further, a spring is installed on an outer circumference of the locking bar to provide an upward elastic force to the locking bar. A hole is formed in the lower frame into or from which a leading end of the locking bar is inserted or withdrawn. A descending portion is formed on a lower side of the hole to seal the hole to thus block a moisture ingress into the container.

According to exemplary embodiments of the present disclosure, the inner lock is configured to lock and unlock the door from inside the container in accordance with the raising and lowering movement of the locking bar, thus providing an effect that the inner lock does not allow opening of the door even when a stranger breaks the fixing parts of the locking rod and attempts to force open the door.

Further, because the door is open and closed by a simple configuration and operation using rotation of the handle hatch and elastic force of the spring, cost of fabrication and installation is reduced. In addition, economic effect further increases since there is no possibility of fault.

DETAILED DESCRIPTION

Hereinbelow, preferred exemplary embodiments of the present disclosure will be described in detail with reference to the accompanying drawings.

Figure 1:
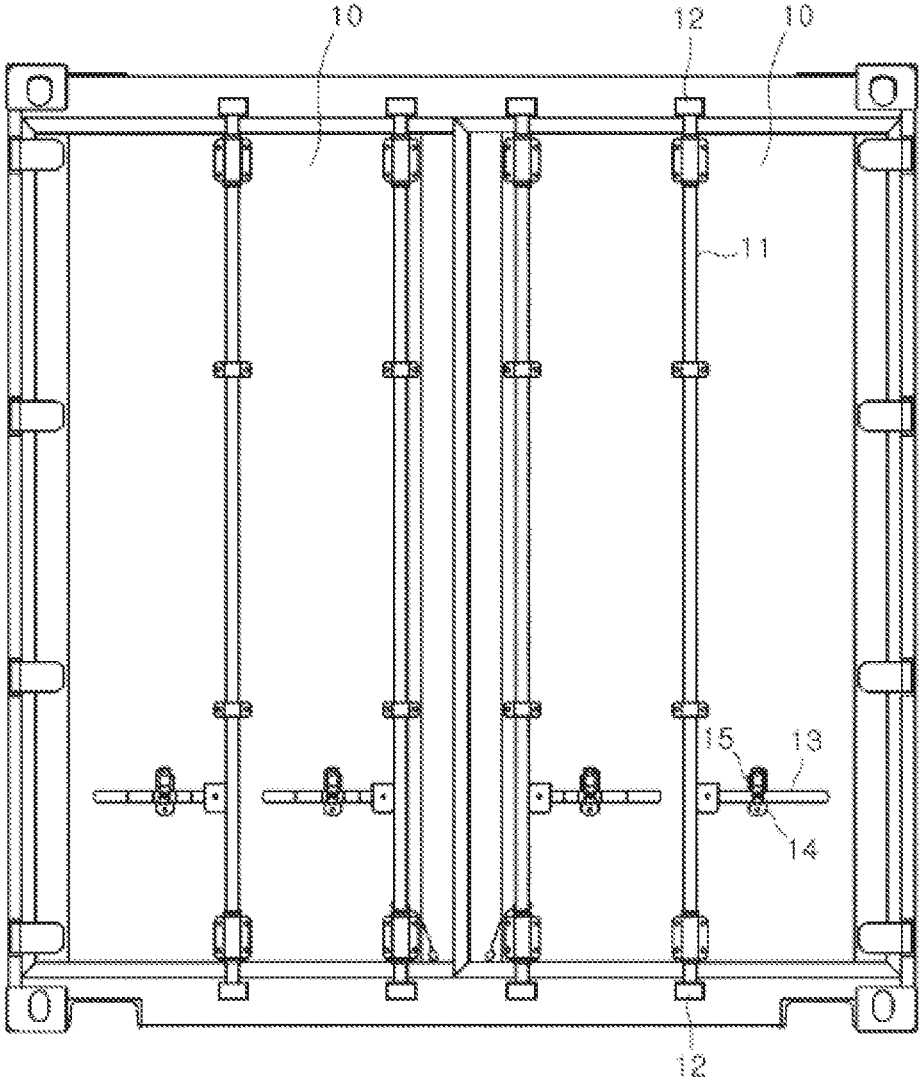
FIG. 1 is a front view of a related lock of a container door.
Figure 2:
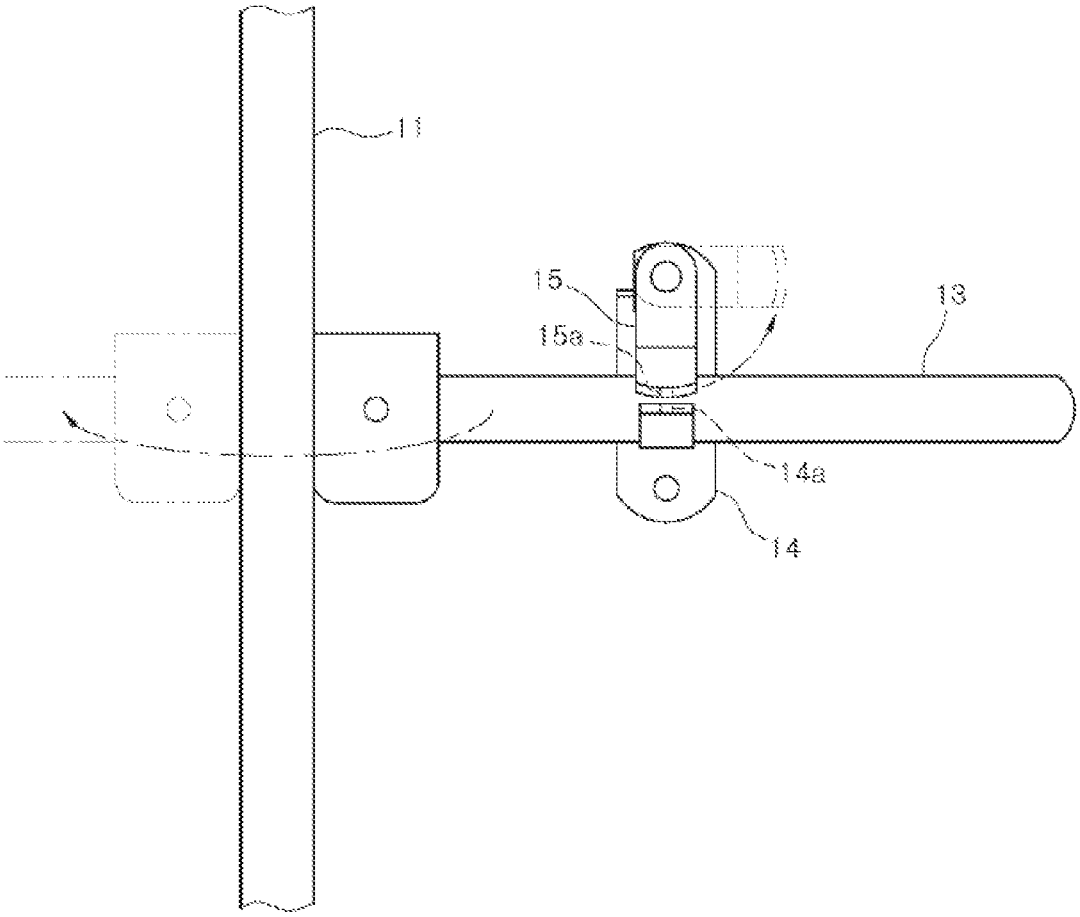
FIG. 2 is a partially enlarged view of a related lock of a container door.
Figure 3:
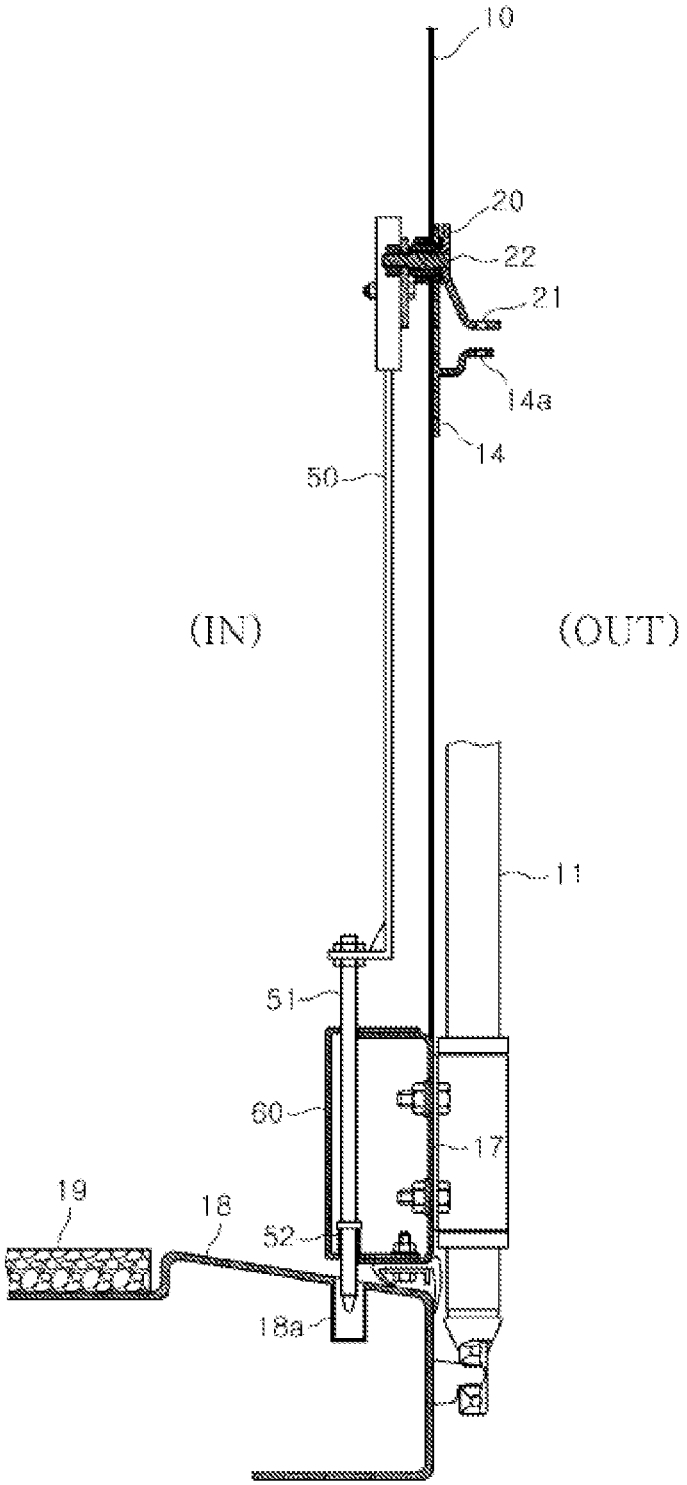
FIG. 3 is a right-side cross-sectional view of an inner lock of a container door according to an exemplary embodiment of the present disclosure.

As illustrated in FIG. 3, an inner lock of a door of a container according to an exemplary embodiment is installed on an inner side of the container and includes a handle hatch 20 coupled with an outer side of the door 10 to open or close the inner lock by a rotation.

Figure 4:
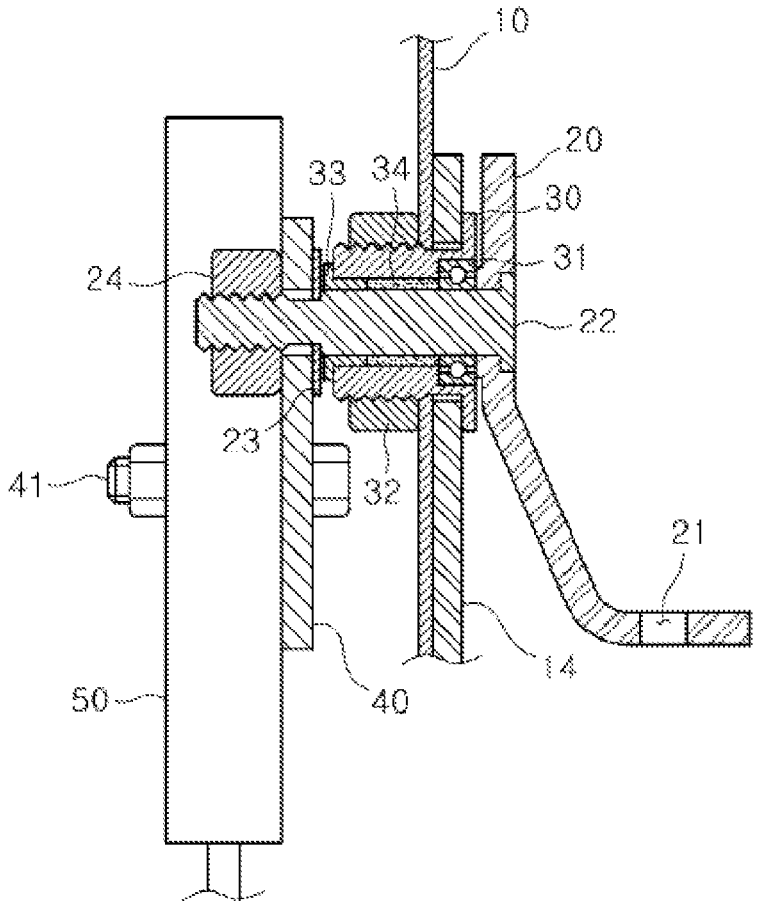
FIG. 4 is a partially enlarged view of an inner lock according to an exemplary embodiment of the present disclosure.

As illustrated in FIG. 4, a binding hole 21 is formed on a lower side of the handle hatch 20, and a rotation shaft 22 extending to an outer side of the door 10 is coupled with a center of the handle hatch 20.

The rotation shaft 22 is passed through the retainer 14 coupled with the outer side of the door 10 and extended to an inner side of the door 10, and a housing 30 is coupled with an outer circumference of the rotation shaft 22, passed through the retainer 14 and the door 10, and fixed at the door 10 by a housing nut 32.

A bearing 31 is coupled with one side of the housing 30 to allow smooth rotation of the rotation shaft 22, and a bushing 33 is coupled with the other side.

Accordingly, a seal space 34 is formed in the inner space of the housing 30, between the bearing 31 and the bushing 33. The seal space 34 may be filled with oil such as grease to block moisture ingress into the container through the space.

Further, a plate 40 is coupled with a leading end of the rotation shaft 22 coupled with the housing 30, and the plate 40 is fixed between a snap ring 23 and a shaft nut 24 coupled with the rotation shaft 22 so as to be rotated together according to a rotation of the handle hatch 20.

Figure 5:
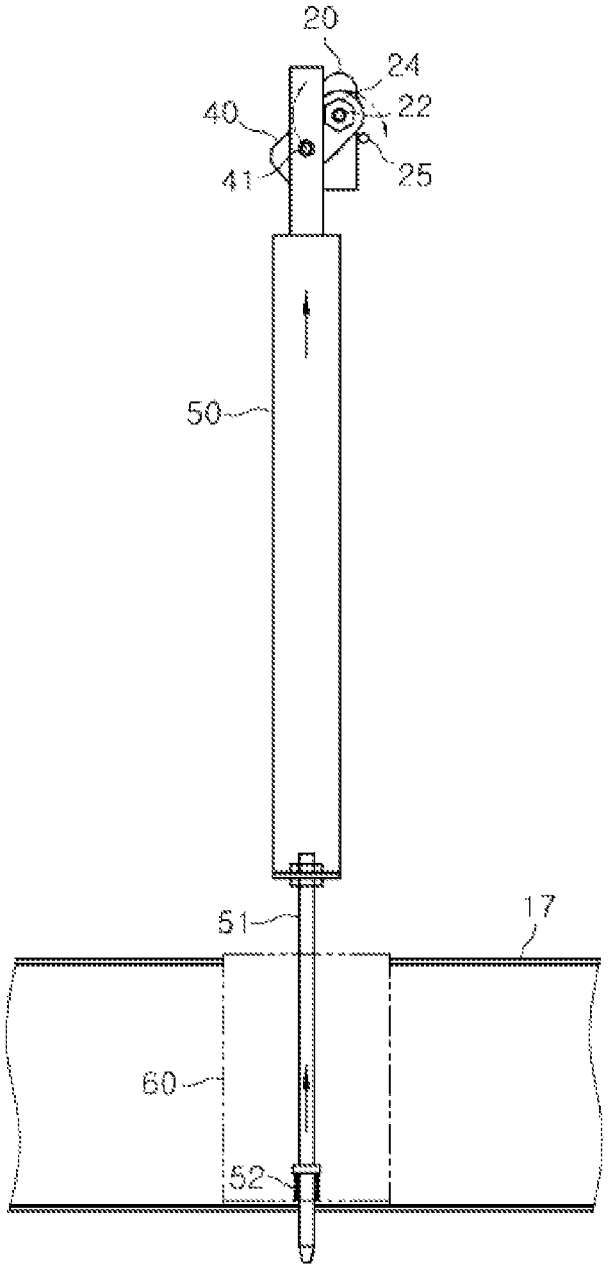
FIG. 5 is a rear view of an inner lock according to an exemplary embodiment of the present disclosure.

As illustrated in FIG. 5, the plate 40 is configured such that, when the door 10 is kept in the locked state, the plate 40 is kept tilted downward by 45° from the rotation shaft 22, and a shaft bolt 41 is coupled to a center of the plate 40. The shaft bolt 41 is passed through an upper end of the lifting member 50 and coupled rotatable by a nut.

The nut is loosely engaged on the shaft bolt 41 so that the lifting member 50 is always kept in a vertical state by being rotated by the load in accordance with the rotation of the plate 40.

A lower side of the lifting member 50 is formed into an approximately '∟' shape, and is coupled vertically with the locking bar 51 by the nut. The leading end of the locking bar 51 is passed through the cover 60 coupled to the door frame 17 and projected to the lower side of the cover 60.

The spring 52 provided on the outer circumference of the locking bar 51 constantly provides the locking bar 51 with an upward elastic force, and the lower frame 18 provided with a wooden bottom plate 19 has a descending portion 18*a* into which the leading end of the locking bar 51 is inserted.

With the inner lock of the container door constructed as described above according to exemplary embodiments, when the door 10 is in a locked state, the handle hatch 20 is in the vertical state, and the locking bar 51 is kept in the lowered state, as illustrated in FIGS. 3 and 5.

Accordingly, due to the locking bar 51 held inserted in the descending portion 18*a*, it is not possible to forcibly open the door 10 from outside. Further, since the locking bar 51 inserted into the descending portion 18*a* is sealing a hole formed in the lower frame 18, moisture ingress into the container can be blocked.

Further, since the binding hole 12 of the handle hatch 20 and the binding hole 14*a* of the retainer 14 provided on the upper and lower sides opposite each other are bound by a wire and a lock, a stranger's unauthorized attempt to rotate the handle hatch 20 and unlock the inner lock can be prevented.

In order to open the door 10, the user rotates the handle hatch 20 in an arrowed direction (i.e., clockwise direction) by 90° as illustrated in FIG. 5. It is preferable that a stopper projection 25 be formed at the door 10 to prevent excessive rotation of the handle hatch 20.

Figure 6:
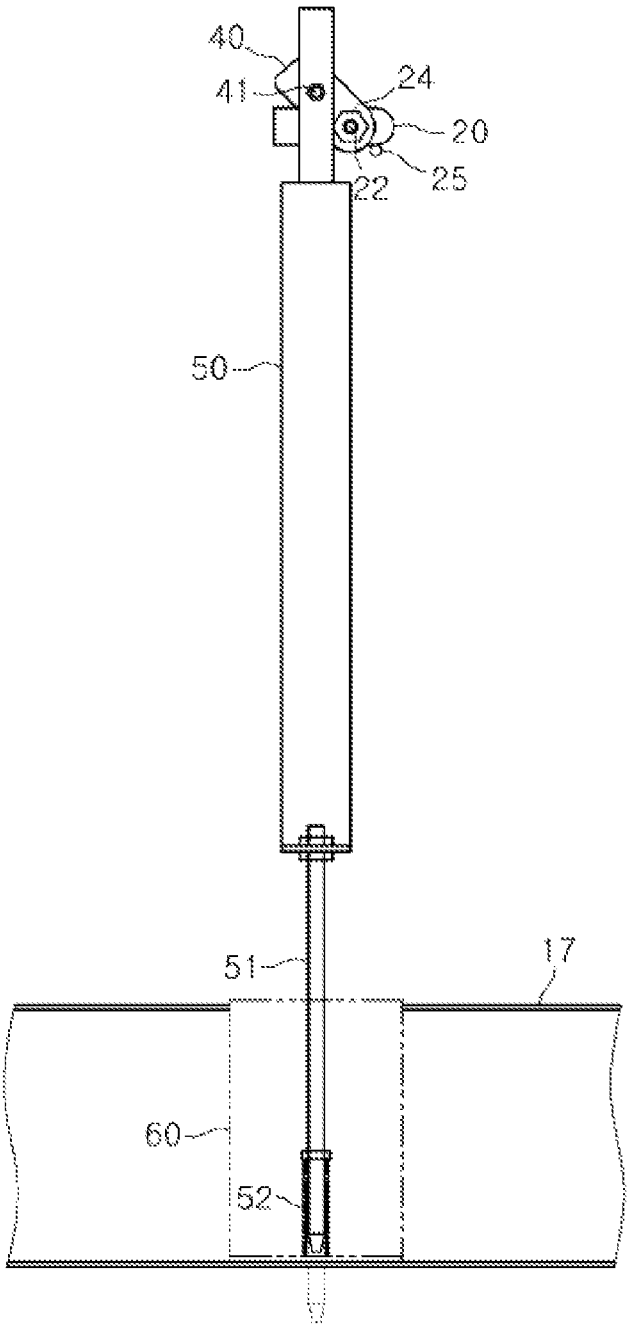
FIG. 6 is a rear view illustrating an inner lock in an open state according to an exemplary embodiment of the present disclosure.

Meanwhile, rotating the handle hatch 20 causes the plate 40 coupled with the rotation shaft 22 to be rotated about the rotation shaft 22 upwardly by 90°, and accordingly, the lifting member 50 and the locking bar 51 are raised to the unlocked state as illustrated in FIG. 6.

Accordingly, the raised locking bar 51 is withdrawn out of the descending portion 18*a* and the door 10 is free to open. The raising movement of the locking bar 51 is further facilitated by the elastic force of the spring 52.

Further, since the spring 52 constantly provides the locking bar 51 with the elastic force in an upward direction, when the door 10 is open, the plate 40 and the handle hatch 20 are prevented from being rotated by the loads of the lifting member 50 and the locking bar 51. Accordingly, the door 10 is prevented from being locked by itself.

In order to lock the door 10, the handle hatch 20 is rotated in a counterclockwise direction by 90° to a vertical state, according to which the plate 40 is rotated downward, and the lifting member 50 and the locking bar 51 are lowered.

Accordingly, the exemplary embodiments of the present disclosure provide an inner lock configured to lock and unlock the door 10 from inside the container in accordance with the raising and lowering movement of the locking bar 51, thus providing an effect that the inner lock does not allow opening of the door 10 even when a stranger breaks the fixing parts of the locking rod 11 and attempts to force open the door 10.

Further, because the door 10 is open and closed by a simple configuration and operation using rotation of the handle hatch 20 and elastic force of the spring 52, cost of fabrication and installation is reduced. In addition, economic effect further increases since there is no possibility of fault.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

INDUSTRIAL APPLICABILITY

The present disclosure is available for use with a container door.

What is claimed is:

1. An inner lock of a container door, comprising:

a rotation shaft;

a plate coupled to a portion of the rotation shaft configured to extend beyond an inner side of the container door;

a lifting member rotatably coupled to the plate; and a locking bar coupled to a lower side of the lifting member, and configured to lock or unlock the container door by being fixed to or separated from a lower frame of the door by lowering or raising of the lifting member, wherein a portion of the rotation shaft configured to extend beyond an outer side of the container door is configured to be coupled to a handle hatch of the container door such that the locking bar is manipulable by rotating the rotation shaft from the outer side of the container door, wherein a housing is coupled with an outer circumference of the rotation shaft, a bearing is coupled with one side of the housing, and a bushing is coupled with another side of the housing, and a seal space is formed between the bearing and the bushing, wherein the seal space is filled with a grease to block a moisture ingress.

2. An inner lock of a container door, comprising:

a rotation shaft;

a plate coupled to a portion of the rotation shaft configured to extend beyond an inner side of the container door;

a lifting member rotatably coupled to the plate; and a locking bar coupled to a lower side of the lifting member, and configured to lock or unlock the container door by being fixed to or separated from a lower frame of the door by lowering or raising of the lifting member, wherein a portion of the rotation shaft configured to extend beyond an outer side of the container door is configured to be coupled to a handle hatch of the container door such that the locking bar is manipulable by rotating the rotation shaft from the outer side of the container door, wherein a spring is installed on an outer circumference of the locking bar to provide an upward elastic force to the locking bar, a hole is formed in the lower frame into or from which a leading end of the locking bar is inserted, or withdrawn, and a descending portion is formed on a lower side of the hole to seal the hole.

* * * * *